United States Patent [19]

Wenzel et al.

[11] 4,106,996

[45] Aug. 15, 1978

[54] METHOD OF IMPROVING THE MECHANICAL RESISTANCE OF COKE

[75] Inventors: Werner Wenzel; Heinrich Gudenau, both of Intzestr., Aachen, Germany; Joachim Bernt, Aachen, Germany

[73] Assignees: Werner Wenzel; Heinrich Wilhelm Gudenau, both of Germany

[21] Appl. No.: 811,147

[22] Filed: Jun. 28, 1977

Related U.S. Application Data

[63] Continuation-in-part of Ser. No. 613,461, Sep. 15, 1975, abandoned.

[30] Foreign Application Priority Data

Sep. 14, 1974 [DE] Fed. Rep. of Germany ..... 2444066
Nov. 29, 1974 [DE] Fed. Rep. of Germany ..... 2456437

[51] Int. Cl.[2] ..... C10B 47/10; C10B 53/08; C10B 51/00

[52] U.S. Cl. ..... 201/6; 201/8; 201/23; 201/26; 201/30; 201/37; 201/40

[58] Field of Search ..... 201/6, 8, 9, 13, 17, 201/18, 20, 23, 30, 37, 40; 48/201

[56] References Cited

U.S. PATENT DOCUMENTS

| | | | |
|---|---|---|---|
| 3,010,882 | 11/1961 | Barclay et al. | 201/6 |
| 3,018,227 | 1/1962 | Baum et al. | 201/9 |
| 3,444,047 | 5/1969 | Wilde | 201/6 |
| 3,560,346 | 2/1971 | Gunter | 201/6 |
| 3,753,866 | 8/1973 | Wenzel | 201/6 |
| 3,907,648 | 9/1975 | Nire | 201/6 |

*Primary Examiner*—Morris O. Wolk
*Assistant Examiner*—Michael S. Marcus
*Attorney, Agent, or Firm*—McGlew and Tuttle

[57] ABSTRACT

A method of improving the mechanical resistance of coke comprises forming a liquor of fine grained coal and oil with the oil being of from 5% to 30% of the total weight, forming coal pellets of the liquor at an increased temperature of from approximately 80° to 100° C, and heating the pellets to transform them into coke in a known coking process. Prior to being carbonized, the pellets are advantageously coated with a separating layer of a substance preventing agglomeration, such as hematite ore, lime, fine coke, etc.

4 Claims, 5 Drawing Figures

METHOD OF IMPROVING THE MECHANICAL RESISTANCE OF COKE

REFERENCE TO ANOTHER APPLICATION

This invention is a continuation-in-part of application Ser. No. 613,461, filed Sept. 15, 1975, now abandoned.

FIELD AND BACKGROUND OF THE INVENTION

This invention relates in general to methods of forming improved coke and, in particular, to a new and useful method of improving the mechanical resistance of coke by forming pellets of a coal and oil liquor which is subsequently transformed into coke in a known coke coking process.

DESCRIPTION OF THE PRIOR ART

The present invention relates to a method of improving the mechanical resistance oc coke made of coals which, when carbonized under normal coking conditions, particularly in coke oven chambers, yield a coke having a low mechanical resistance. This is the case, for example, with the carbonization of relatively low volatile coking coals having a content of approximately 16% of volatile matter. Coke obtained from such coals is usually of a small size and has a strong tendency to break apart under stress.

It has been found that with coals having such poor coking properties, coke with a satisfactory mechanical resistance can be obtained, particularly by carbonization in ordinary coke oven chambers, if larger quantities of heavy oil, tar, or other hydrocarbons boiling at higher temperatures are added to the coal prior to the carbonization. It is well known for a relatively long time, to carbonize mixtures of coal and oil. However, experience has shown that under normal coking conditions, no notable increase in the mechanical resistance of the coke produced is obtained.

SUMMARY OF THE INVENTION

In accordance with the present invention, in order to produce resistant coke from coal-oil mixtures, fine grained coal is mixed with oil to obtain a pelletizing liquor which is formed into coal-oil pellets having an oil content of approximately 5% to 30% by weight, and preferably, about 20% to 25% by weight. To ensure the agglomeration of the fine coal with added heavy oil, tar, or other hydrocarbons boiling at higher temperatures, the pelletizing process is carried out at an increased temperature, such as approximately 80° to 100° C.

For pelletizing at these temperatures, usual pelletizing devices are used, such as pelletizing trays or drums; and prior to the pelletizing, the oil is brought up to a temperature of about 120° C, this temperature depending on the viscosity properties of the oil. The coal fed to the pelletizing tray has either a normal temperature or is slightly heated, for example, to 50° - 60° C.

The coal-oil pellets thus produced, after cooling down, can be bunkered, transported and relocated without breaking apart so that favorable conditions are obtained for handling such intermediate products in the coking plant.

While carbonizing these coal-oil pellets in normal coke oven chambers, resistant lump coal is obtained having a shatter strength and abrasive resistance substantially superior to that of a coke produced from non-pelletized coal-oil mixtures. According to a development of the invention, form coke may be made of the coal-oil pellets, following well known methods, such as continuous coking methods, for example, in a sand bed, or coking in a shaft furnace with circulation-gas heating. It is particularly advantageous, however, to use normal chamber coking plants for this purpose and to adapt them to the production of form coke. While using normal coke-oven chambers for the coking, i.e., with an indirect heating, coal-oil pellets are used which are provided, prior to the coking, with separating coatings preventing an agglomeration or fusing of the individual coal pellets during the heating. Layers of fine-grained substances having a thickness of approximately 0.2 to 2 mm, preferably about 0.5 mm, and applied in the pelletizing process have proven to be advantageous as such separating coatings. These layers applied in the pelletizing process may comprise fine grained substances, such as hematite ore, lime, coke, fines, etc. The layer thickness depends on the nature of the substance. Thus, hematite ore is particularly effective due to its oxidizing influence on the coking bitumen and, therefore, may be applied in very thin layers while, for example, lime is effective only physically as a separating layer and must be used in thicker layers.

In the coking of coal-oil pellets, such separating layers have a further purpose, namely, of acting as a desulfurizing agent. Heavy oils frequently contain larger quantities of sulfur, in particular if, in a desirable manner, cheap heavy oils are used, and it is therefore necessary to provide for a desulfurization of the coke, as far as possible, during the carbonization process. This desulfurization can also be obtained by using lime, since under the given reducing conditions, during carbonization, lime is converted into calcium sulphide. In place of coal-oil pellets, other coal-oil agglomerates may be used, for example, oil-bonded coal briquets.

The present invention makes it possible to approach another objective in the development of the coal carbonization, namely, to reduce the carbonization time in the chamber coking. While in normal cases, with a rapid heating of the coal, a very fissured and relatively small grained coke is produced, the rapid heating, in accordance with the invention, takes place under conditions which are substantially more favorable. Even with a reduction of the carbonization time by approximately 33%, the method in accordance with the invention does not lead to any notable decrease in the shatter strength of the form coke pieces produced in coke oven chambers.

Due to the fact that while using coal-oil pellets, an extensive regular interspace volume is formed within the charge of the coke oven chamber in the period of time up to the softening of the charge at approximately 450° - 500° C, a very advantageous rapid heating of the chamber content is made possible. In accordance with the invention, after charging the chamber, up to the time at which the interspaces become clogged by the fusing coal, hot gas is directed through the coal charge, whereby, the coal is heated up, in a relatively short time, to temperatures of about 350° to 400° C. Subsequently, heating takes place in a well-known manner, indirectly, through the chamber walls.

Flue gas may be used as the heating gas. In this case, however, it would be necessary to recover the vaporized hydrocarbons from the waste gas of the coking chamber during the direct-heating period. It is therefore more advantageous to use the waste gas of coking chambers which have already been brought to the corresponding high temperature and to blow it, close to the bottom, as heating gas into such chambers which are going to be heated up directly. In such a case, the waste gas of these chambers may be directly added to the output gas of the coking plant.

It may happen that the oil necessary for forming the lumps of fine grained coal cannot be supplied to the coking plant in a satisfactory quantity, or at all. In such a case, it is possible to recuperate the heavy oil or the tar produced during the coking of the coal and to recirculate it to the coal pelletizing or briquetting station.

These hydrocarbons which are fed back into the coking chamber along with the new coal to be carbonized are partly evaporated again during the carbonizing process. In addition, they are also cracked partially so that the carbon produced by the cracking increases the yield obtained by the carbonization. During the cracking, again volatile hydrocarbons boiling at high temperatures are produced which, subsequently, are precipitated along with the recirculated and reevaporated hydrocarbons. This circulating quantity of high boiling oils is gradually increased by the quantity newly produced during the carbonization of the coal.

In this manner, due to the permanent recirculation, even with a relatively small yield of recyclable oils obtained during the carbonization of a used coal, the total quantity of oil is constantly increased so that quantities in the amount of approximately 10% to 15% of the used coal necessary for the pelletizing or briquetting are finally attained and exceeded. It is possible, therefore, except for a certain quantity to be added at the beginning of the cycle, to dispense with the supply of pelletizing oil or briquetting bitumen from outside the plant. Usually, after the recirculation is stabilized, a certain amount of oil in excess is obtained which may be delivered as output.

A great advantage of the recirculation method is that, in practice, no tar to be delivered outside is obtained in the carbonization process and the components of the crude coke oven gas, primarily those with the highest boiling point, are permanently recirculated, while the oils from lower boiling fractions, perhaps obtained in excess, may be removed.

It might be advantageous, above all in the carbonization of coals having a higher content of bitumen, to influence the cracking rate of the recirculated oil during the reheating in the coke oven chamber. This may be done, in accordance with the invention, so that cracking catalysts, known per se, such as aluminum chloride, bentonit or the like, are added to the oil recycled for pelletizing or briquetting. The result thereof is that, fed back into the coke oven chamber, a desired or appropriately predetermined quantity of cracked carbon, controlled by the quantity of added catalysts, is separated during the reheating.

The inventive method may be used for both the carbonization of coals which, under normal conditions, yield but coke with relatively little strength, and for formally coking coals.

Accordingly, it is an object of the invention to provide a method of improving the mechanical resistance of coke, which comprises forming liquor of a fine-grained coal and oil, with the oil being of from 5% to 30% of the total weight, forming pellets of the liquor at increased temperatures of from 80° to 100° C, and heating the pellets to transform them into coke.

DESCRIPTION OF THE PREFERRED EMBODIMENTS

Figure 1:
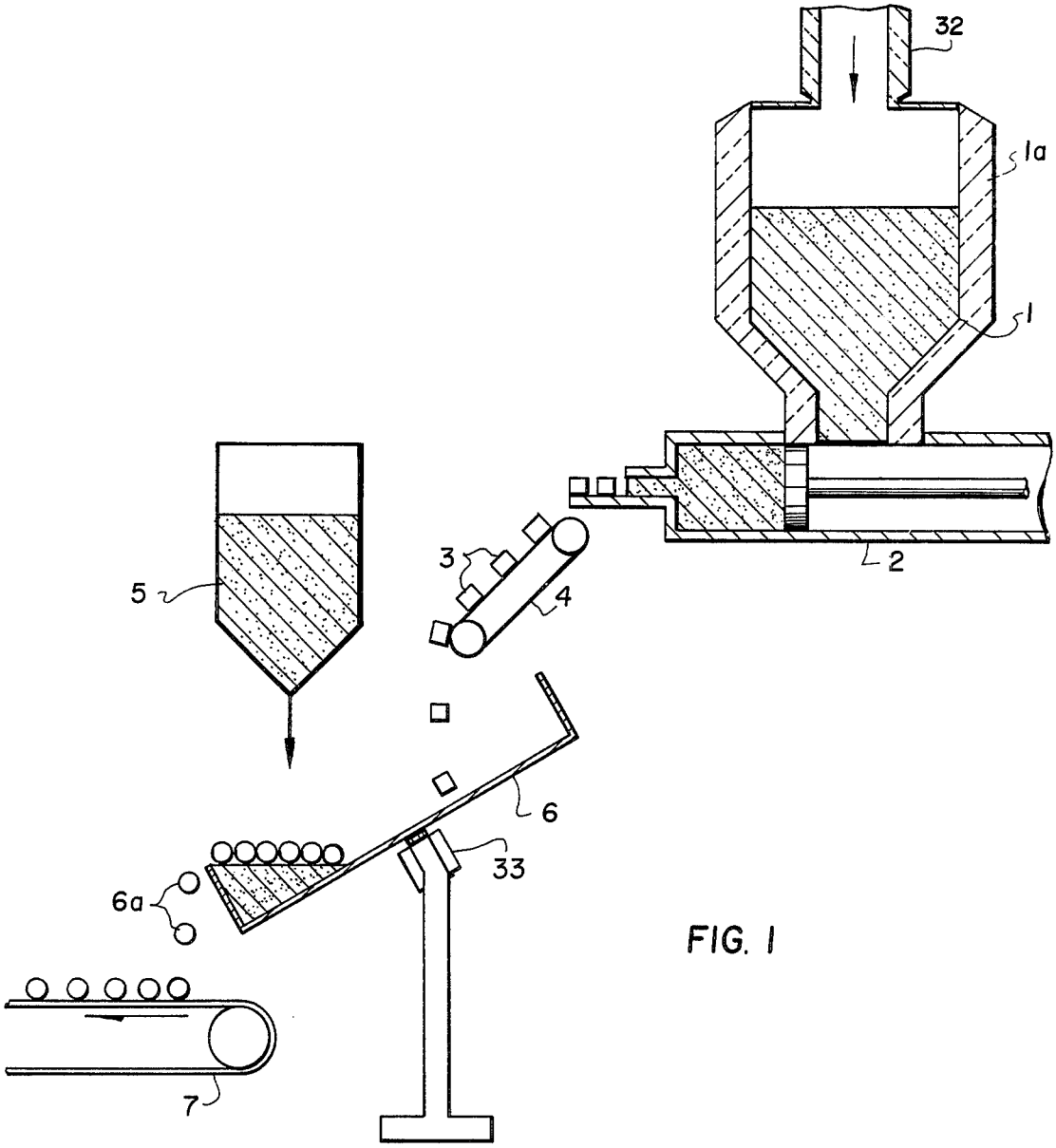
FIG. 1 is a schematic partial elevational and partial sectional view of an apparatus for carrying out the method of the invention.

Referring to the drawings in particular the inventive method is carried out as shown in FIG. 1 by delivering fine coal from a bunker 1 into a press which is schematically indicated at 2 in a manner to form individual briquettes 3 which are delivered out of the press and separated into the pellets and moved off onto a conveyor 4. A coal heavy oil mixture is passed through a connection 32 into the bunker 1. The bunker 1 is provided with a thermal insulation 1*a*.

The pellets which are delivered off the conveyor 4 are transferred to a pellet receiver or tray 6 which comprises a tray which is rotated by a motor 33. The individual pellets become positioned at the lower end of the tray, below a bunker 5 which contains a coating material which is delivered onto the pellets as they are rotated slowly on the tray 6. The coating material comprises for example coke, lime, or iron ore. During the rotation of the pellet in the receiver 6 the briquettes become coated with the fine coating material and they partly lose their rectangular shape due to the abrasion as they are rotated. The coated, partly rounded, briquettes 6*a* fall onto a conveyor 7 by which they are transported into an oven chamber.

Figure 2:
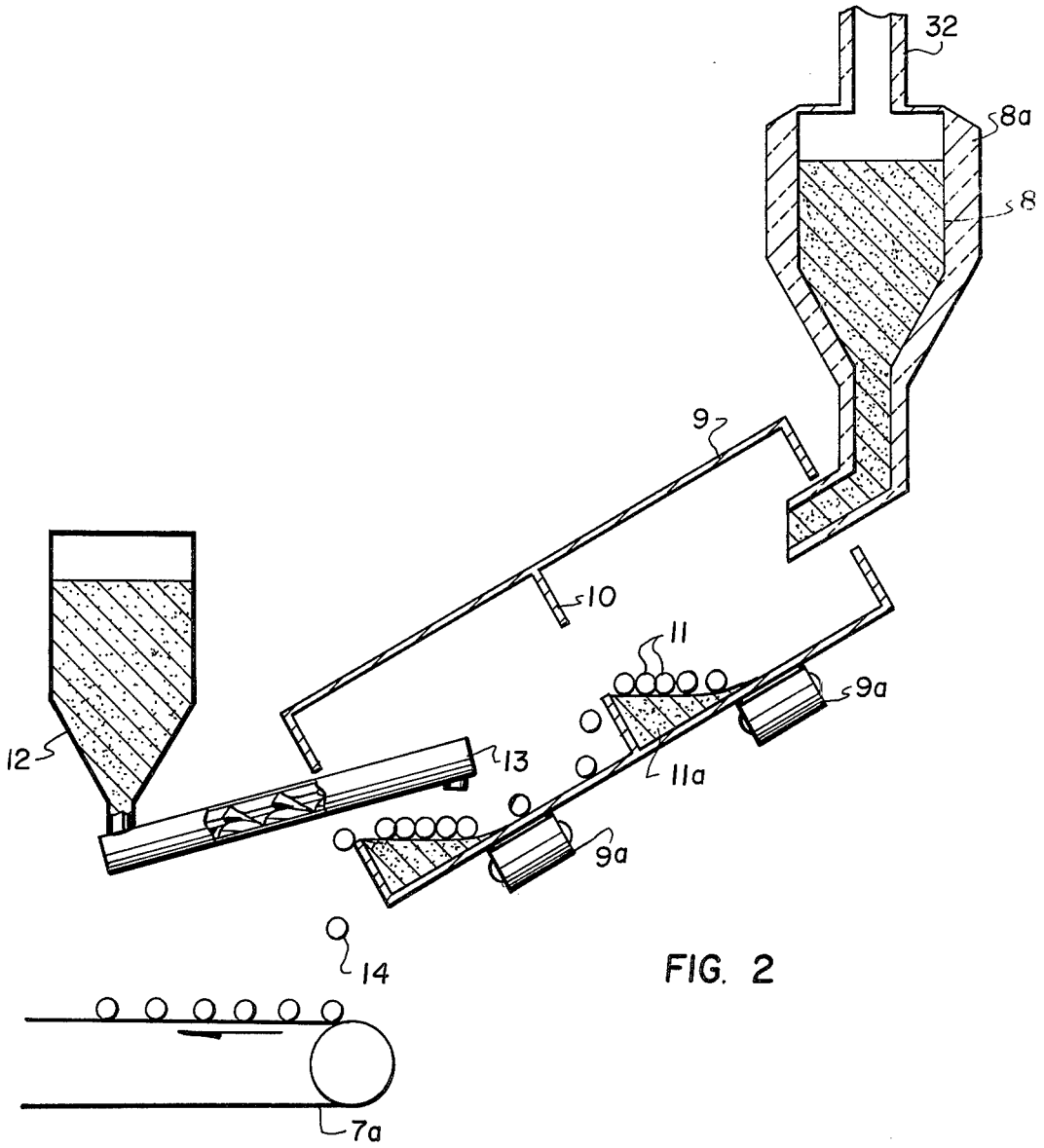
FIG. 2 is a view similar to FIG. 1 showing another embodiment of the method.

A slightly varied method is shown in FIG. 2 wherein a coal oil mixture is supplied through a connection 32 into a bunker 8 which has a thermal insulation 8*a*. From the bunker 8 it is fed into the upper part of a rotary tube 9. The tube 9 is rotated by means of driving roller elements 9*a* and during the rotation the pellets 11 are made from the fine coal which is delivered out of the bunker 8 into the rotary tube 9. The pellets accumulate at a parting ring 10 arranged within the tube 9 and they drop through the central opening thereof into the lower part of the rotary tube 9. The coating material such as fine coke for exzmple is received in the bunker 12 and delivered through a screw conveyor 13 to the lower part of a rotary tube 9. The fine coal which is fed from the bunker 8 accumulates at 11*a* in the tube 9 and the pellets 11 are formed by portions of this material. The pellets which become fully coated with the fine material fall onto the conveyor 7*a* and they are delivered into a coke oven chamber from the conveyor 7*a*.

Figure 4:
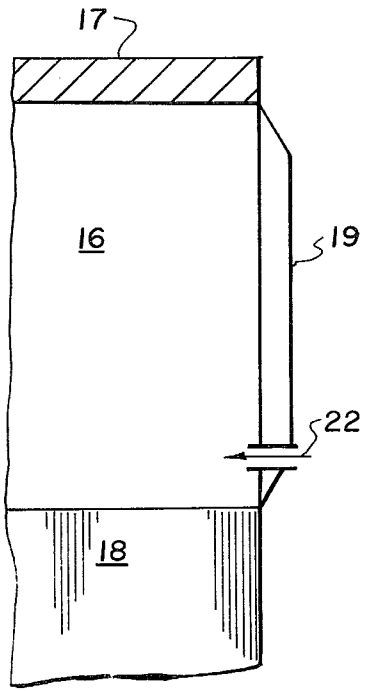
FIG. 4 is a partial sectional view showing a detail of the coke oven door chamber.
Figure 3:
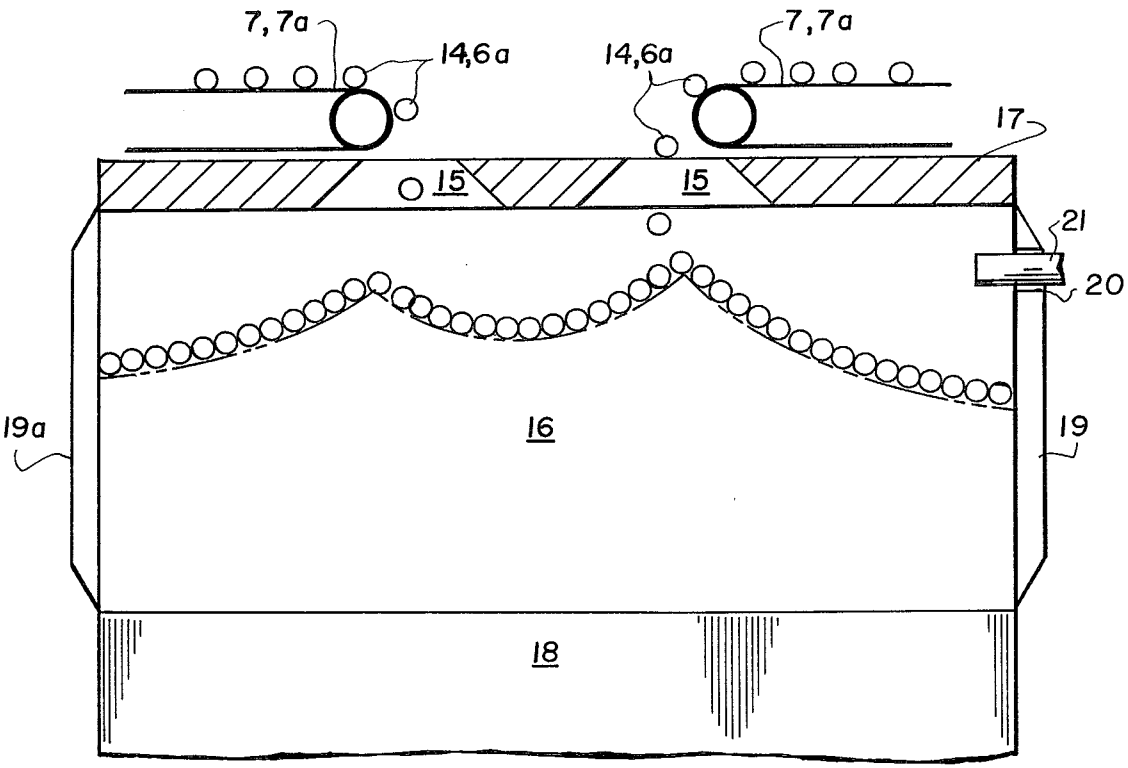
FIG. 3 is a partial sectional view through a coke oven which is arranged to receive the pellets made in accordance with the method of the invention.

FIG. 3 shows how coated briquette 6*a* or coated pellet 14 are delivered by either conveyor 7 or 7*a* through filling openings 15 provided in a roof 17 of a coke oven 16 of a battery. Oven chamber 16 is closed by doors 19 and 19*a*. At the pusher side, the levelling rod 21 is introduced through opening 20 in the oven door 19 for levelling the charge. The coke oven includes a regenerator structure which is schematically indicated at 18. FIG. 4 shows a gas inlet 22 in the door 19 of the coke oven chamber through which hot gases are blown into the oven chamber.

Figure 5:
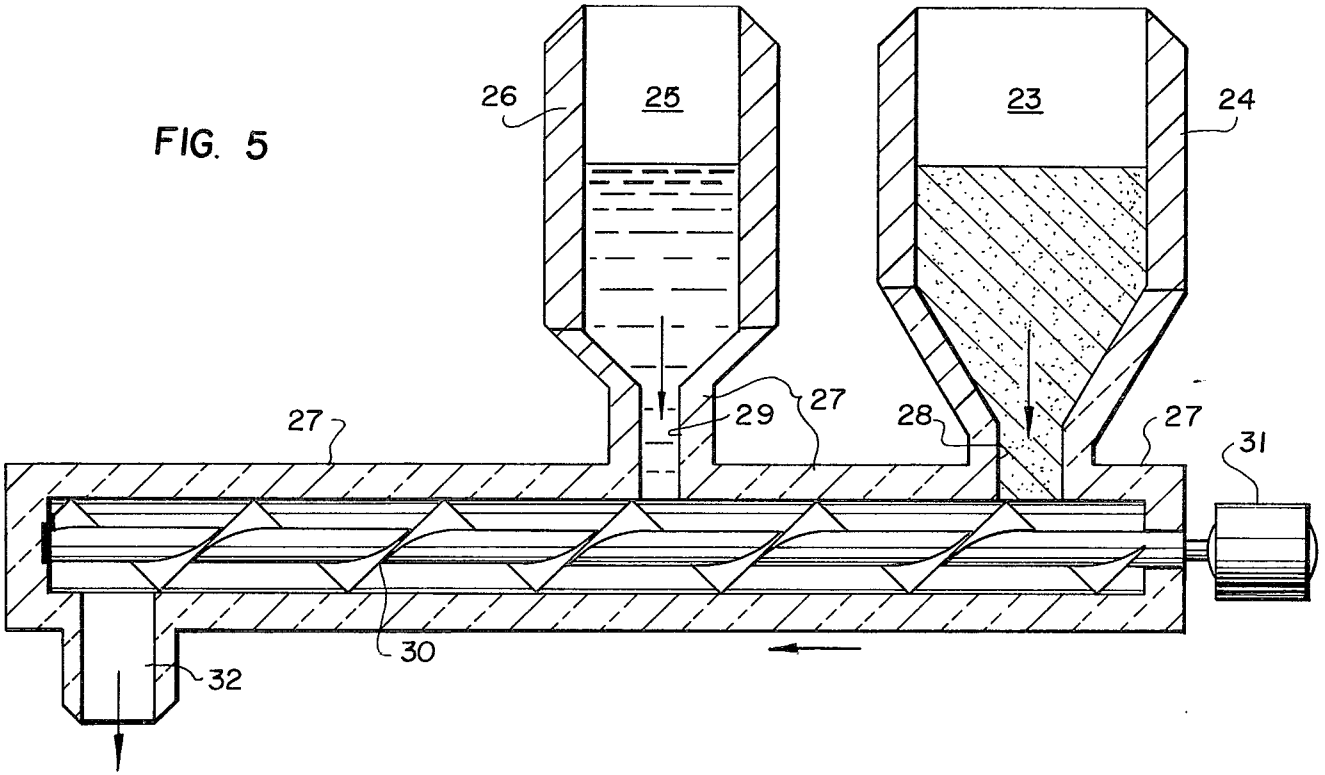
FIG. 5 is a view similar to FIG. 1 of an apparatus for carrying out another embodiment of the method.

In the embodiment of FIG. 5, fine coal is heated in a bunker 23 having a heating jacket 24 and insulation 27, to a temperature of 100° C and kept at this temperature. Through connection 28, the coal trickles onto insulated conveyor screw 30. Heavy oil flows from bunker 25, where it is heated, through heating jacket 26, to a temperature of 100° C and kept at this temperature, through connection 29, to conveyor screw 30, which is driven by a motor 31 and is mixed with the coal and discharged through connection 32.

Bentonite or aluminum chloride is admixed to the oil for use for pelletizing the coal in a mixer tank 50 prior to the mixing of the oil with the coal in a tank or hopper 52. This is advantageous in the case of carbonization of coals having a higher content of bitumen in order to influence the cracking rate of the recirculated oil during the reheating in the coke chamber. This may be done in accordance with the invention so that the cracking catalysts which are known per se, such as aluminum chloride, bentonite or similar substances are added to the oil which is recycled for pelletizing or briquetting.

In accordance with the invention, a coke is formed in an improved manner in order to produce a product which has increased mechanical resistance. In the preferred form of the invention, a liquor of fine-grained coal and heavy oil is formed with the oil being of a content of about from 5% to 30% of the total weight of the liquor. Whole pellets are then formed of the liquor, the pelletizing taking place at an increased temperature of approximately from 80° to 100° C, and thereafter, the pellets are transformed into coke by the usual coking processes. The details of the method of the invention are illustrated by the following four examples:

EXAMPLE 1

A bituminous coal having 15.1% of volatile matter (water- and ash free) and a grain size of less than 1 mm has been filled into a carbonization retort having an inside diameter of 2.5 cm and a height of 60 cm. The coal was heated through the retort walls so as to obtain a maximum coking temperature of 1000° C within 6 hours in the middle zone of the retort.

The coke produced had a grain size of 23.6% above 30mm and 45% of fine coke below 10mm. The coke above 30mm in cold state has been stressed in a standard drum (MIKUM) with 100 revolutions during 4 minutes. The coke strength M 30, i.e., the quantity of coke above 30 mm grain size filled into the test drum, which, after the test, still had a grain size above 30 mm, was 0%. The abrasion M 10, i.e., the grain size below 10mm after the treatment in the drum, was 90%. The sulfur content was 0.84%.

EXAMPLE 2

The same coal, as in Example 1, has been mixed with 24.5% by weight of heavy oil at a temperature of 80° C. The heavy oil had a fixed carbon content of 15%, its total carbon content was about 90%, the hydrogen content was 8%. The sulfur content of the heavy oil was about 2.8%.

The coal-oil mixture has been carbonized in the same retort as in Example 1, at the same coking temperature and during the same coking time.

The grain size of the coke produced was 60.8% above 30mm and 13.8% of fine coke below 10mm. The sulfur content of the coke was about 1.08%.

EXAMPLE 3

The same coal as in Examples 1 and 2 has been crushed to a grain size below 1 mm and pelletized on a pelletizing tray with heavy oil which was the same as in Example 2. Prior to pelletizing, the heavy oil was brought to a temperature of 120° C; the quantity of added oil was 24.8% by wright. The coal-oil pellets produced had a diameter of about 40 mm.

In the pelletizing process, an approximately 2mm thick layer of burnt lime has been applied to the coal-oil pellets.

The coal-oil pellets provided with a lime shell were filled into the same carbonization retort as in Examples 1 and 2. The coking time was 6 hours, until the maximum coking temperature of 1000° C in the middle zone of the retort was obtained. The coke cake produced broke apart into individual coke pieces of approximately uniform size corresponding to the size of the coal-oil pellets used. The greatest part of the lime shells fell off the coke pieces during the taking apart of the coke cake. It was possible to separate the shells from the coke by screening practically completely. During this screening operation, the lime shells disintegrated to an extent such that lime powder was obtained which could be separated from the fine coke by screening or air sifting. The coke produced had a grain size of 90.5% above 30mm and 2.4% of fine coke below 10mm. The drum strength M 30 was 77.2%, the abrasion M 10 about 12.2%. The coke produced has a sulfur content of about 0.92%. The sulfur content of the only once used lime was about 1.55%.

EXAMPLE 4

The same coal has been treated with the same oil and under the same conditions as in Example 3, only with the following modifications:

1. Through holes in the bottom of the carbonization retort, hot flue gas has been blown in as from the start of the carbonization up to reaching a temperature of 380° C in the middle zone of the retort, and it is evacuated at the head thereof. The initial temperature of the flue gas was 650° C.

2. The total coking time was 4 hours. The coke produced had a grain size of 88.6% above 30 mm and 3.8% of fine coke below 10 mm. The drum strength M 30 was 76.8%, the abrasion M 10 about 12.9%. The sulfur content of the coke produced was about 0.9%. During the removal from the retort, the coke cake behaved in the same manner as set forth in Example 3.

While specific embodiments of the invention have been set forth and described in detail to illustrate the application of the principles of the invention, it will be understood that the invention may be embodied otherwise without departing from such principles.

What is claimed is:

1. A method of improving the mechanical resistance of coke, comprising forming a liquor of fine grained coal and oil, with the oil being approximately 5% to 30% of the total weight, forming briquettes from the liquor at an elevated temperature in the range of approximately 80° C to 100° C, delivering said briquettes to a rotating cylinder having a parting ring therein between the ends thereof, rotating said cylinder to transform said briquettes into rounded pellets, discharging said pellets by passing said pellets through said parting ring and out of said rotating cylinder, passing said discharged pellets to a coke oven chamber and placing said pellets in said chamber to form spaces therebetween, heating said pellets in said coke oven chamber to form an improved coke by directing hot gas through said spaces between said pellets, from openings provided in the bottom of said chamber, until said spaces become clogged by the fusing coal, said hot gases comprising gases from a coke oven chamber which is already heated up to a correspondingly high temperature, and recycling oils produced during the coking process and separated from said heating gases to form part of said liquor.

2. A method of improving the mechanical resistance of coke, according to claim 1, wherein the pellets, prior to their being carbonized, are coated with a separating layer of a substance preventing agglomeration and having a thickness of approximately from 0.2mm to approximately 2mm.

3. A method of improving the mechanical resistance of coke, according to claim 2, wherein the weight of the oil in the pellets is preferably approximately from 20% to 25% of the total weight, and wherein, the substance added to prevent agglomeration comprises a substance, such as hematite ore, lime, fine coke.

4. A method according to claim 1, wherein the rounded pellets are delivered into the coke oven at a plurality of locations so that they pile up in conical mounds, and including periodically levelling the mounds of briquettes.

* * * * *